United States Patent [19]

Young

[11] 4,099,435

[45] Jul. 11, 1978

[54] CUTTING KNIFE FOR WINDING MACHINES

[75] Inventor: Roger W. Young, Upper Montclair, N.J.

[73] Assignee: John Dusenbery Company, Inc., Clifton, N.J.

[21] Appl. No.: 773,080

[22] Filed: Feb. 28, 1977

[51] Int. Cl.[2] ..... B26D 5/12
[52] U.S. Cl. ..... 83/614; 83/455
[58] Field of Search ..... 83/614, 455, 639

[56] References Cited

U.S. PATENT DOCUMENTS

| | | | |
|---|---|---|---|
| 3,213,735 | 10/1965 | Keferstein et al. | 83/614 X |
| 3,277,761 | 10/1966 | Dreher | 83/614 |
| 3,779,121 | 12/1973 | Lagain | 83/614 |

*Primary Examiner*—Donald R. Schran
*Attorney, Agent, or Firm*—Rudolph J. Jurick

[57] ABSTRACT

A cutting knife assembly for severing a strip of material after it has been wound on a core and the winding operation is to be continued on a new core.

9 Claims, 13 Drawing Figures

CUTTING KNIFE FOR WINDING MACHINES

BACKGROUND OF THE INVENTION

In the operation of a conventional slitting and rewinding machine, a relatively wide web of material, such as paper or plastic film, is passed through a slitting station where the web is slit longitudinally across it's width into a number of narrow strips which then are wound into rolls on cores carried by a mandrel. When the cores are fully wound they are transferred to an unloading station and the strips are severed so that their leading ends can be wound on empty cores carried by another mandrel. Certain existing strip severing arrangements utilize a plurality of rotary cutting knives corresponding in number to the strips to be severed. Other existing arrangements utilize a pair of elongated knife blades extending across the machine and operated in a scissor-like manner. The prior arrangements are expensive, require sharp cutting edges and occupy considerable space on the machine.

A strip-severing knife arrangement made in accordance with this invention requires a minimum number of parts, can operate in restricted locations and results in a positive, clean severing of the strip of material.

SUMMARY OF THE INVENTION

A shuttle is slidably positioned in a supporting tube provided with a longitudinally-extending, narrow slot. A cutter member is carried by the shuttle and extends through the slot. The strips of material to be severed pass over the slot and the shuttle is driven from one end of the tube to the other, thereby severing the strips.

An object of this invention is the provision of an improved arrangement for severing one or more strips of material wound on cores.

An object of this invention is the provision of a strip-severing arrangement in which the strip passes over a slot formed in a tube and the severing operation is performed by a cutter member extending through the slot and driven from one to the other end of the tube.

An object of this invention is the provision of a cutting knife assembly for a strip winding machine, which assembly includes a shuttle slidable in a tube provided with a longitudinal slot, the shuttle carrying a cutter blade extending through the slot.

The above-stated and other objects and advantages of the invention will be apparent from the following description when taken with the accompanying drawings. It will be understood, however, that the drawings are for purposes of illustration and are not to be construed as defining the scope or limits of the invention, reference being had for the latter purpose to the claims appended hereto.

BRIEF DESCRIPTION OF THE DRAWINGS

In the drawings wherein like reference characters denote like parts in the several views.

DESCRIPTION OF PREFERRED EMBODIMENTS

Figure 1:
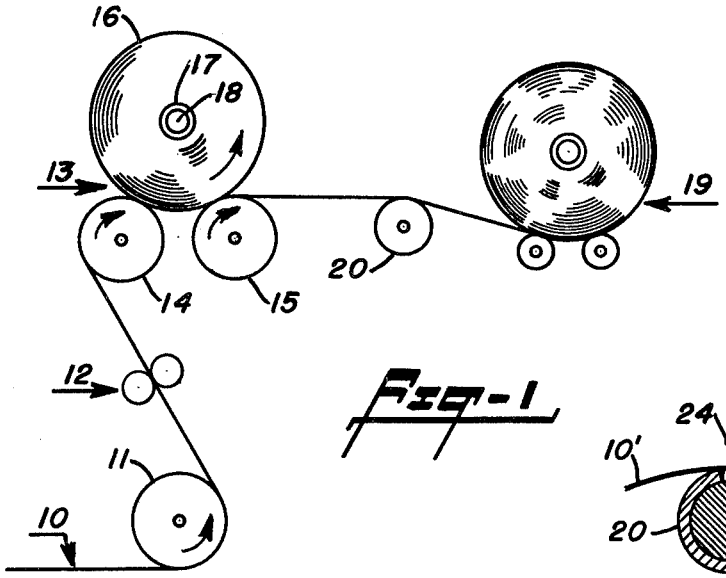
FIG. 1 is a diagrammatic representation, in end elevation, of a slitting and rewinding machine having a strip severing mechanism made in accordance with this invention.
Figure 3:
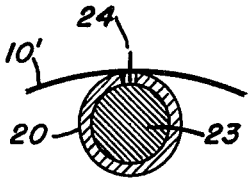
FIG. 3 is a cross-sectional view taken along the line 3—3 of FIG. 2.
Figure 2:
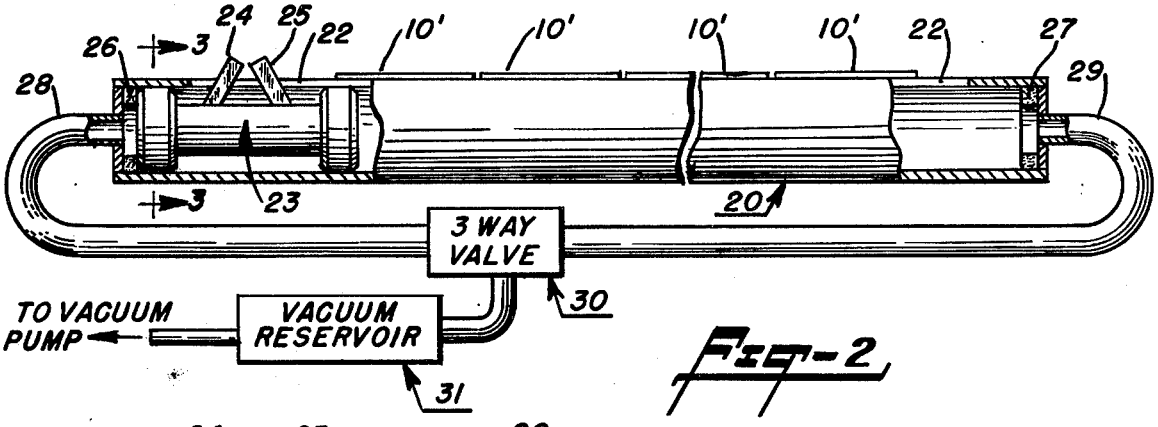
FIG. 2 is a side elevational view of a strip severing mechanism made in accordance with one embodiment of this invention and including means for driving the shuttle, portions of the mechanism being shown in cross-section.

Referring to FIG. 1, a relatively wide web 10 passes over an idler roll 11 and through a slitting station 12 where the web is slit longitudinally across its width into a plurality of strips. At a winding station 13, which includes the winding drums 14 and 15, the individual strips are wound into rolls 16 on cross 17 carried by a mandrel 18. When the rolls are fully wound, the winding operation is stopped and the mandrel is transferred to an unloading station 19 with the strips passing over a supporting tube 20 which carries the strip-severing knife mechanism. Such mechanism is shown in FIGS. 2 and 3. The tube 20 has a longitudinal slot 22 which extends beyond the edges of the outermost of the strips 10' of the slit web. Slidable positioned within the tube 20 is a shuttle 23 carrying a pair of angularly oriented razor blades 24 and 25 having end portions thereof extending through the slot 22. Normally, the shuttle is positioned at one end of the tube against one or the other resilient washers 26, 27 and the length of the tube is such that the projecting portions of the blades are spaced from the outermost strip. The shuttle preferably is made of a suitable plastic having a low coefficient of friction and its enlarged end portions fit closely within the tube 20. Air lines 28 and 29 are connected between the ends of the tube 20 and a 3-way valve 30, which valve also is connected to a vacuum reservoir 31. To effect the strip-severing action, the valve is operated to connect the air line 29 to the reservoir, whereby the reduced air pressure in the tube 20 causes the shuttle to move to the other end of the tube. The reduced air pressure in the tube 20 tends to draw the strips 10' into the tube slot 22 resulting in a stretching of the strips and thereby assuring a positive, clean severing of the strips by the forward razor blade 25 as the shuttle moves through the tube. The next strip-severing cycle is effected by operating the valve 30 so that the air line 28 is connected to the vacuum reservoir, whereby the strips are severed by the blade 23 as the shuttle is returned to its previous starting position.

Figure 4:
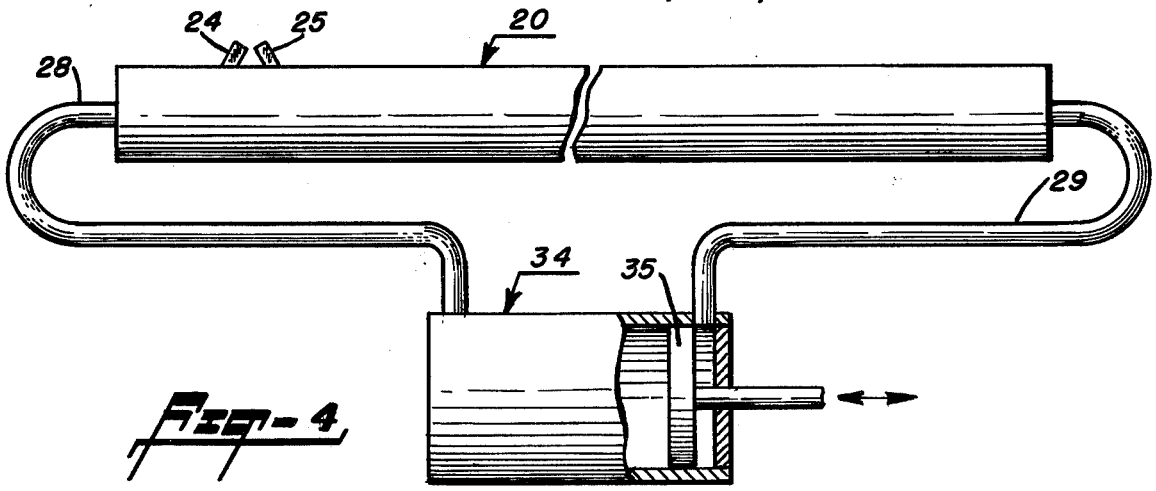
FIG. 4 is a side elevational view corresponding to FIG. 3 but showing another means for driving the shuttle.

In the FIG. 4 arrangement, the air lines 28 and 29 connect the ends of the shuttle-carrying tube 20 to an air cylinder. The piston 35 is movable in one or the other direction by suitable means. When the piston 35 is moved to the left, there is a temporary reduction in the air pressure within the tube 20 and a corresponding increase in the air pressure effective against the left end of the shuttle. The resulting pressure difference at the shuttle ends drives the shuttle to the right hand end of the tube 20 and the blade 25 sever the strips. Movement of the piston 35 to the right causes the shuttle to return to its initial position with blade 24 severing the strips.

Figure 5:
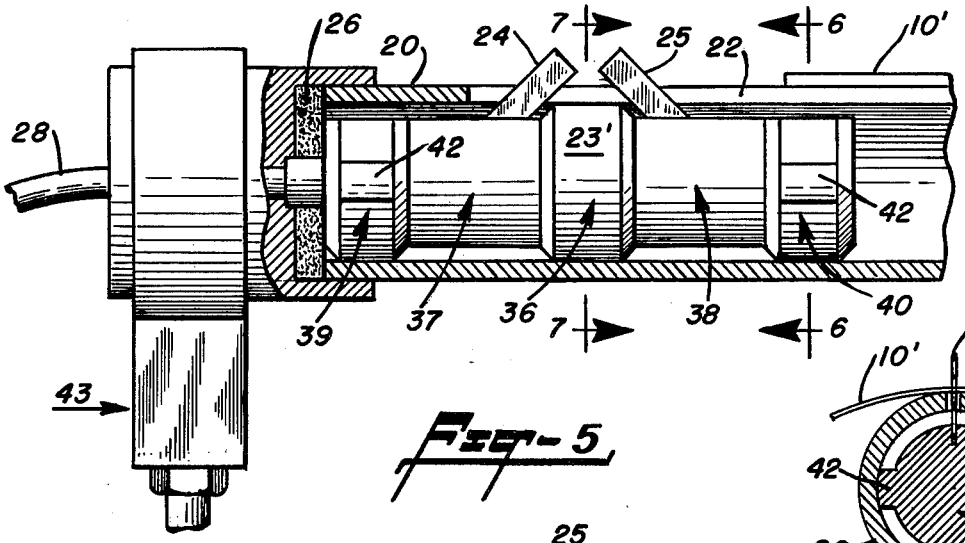
FIG. 5 is an enlarged, fragmentary, side elevational view, with portions in cross-section, showing a shuttle made in accordance with another embodiment of the invention.
Figure 6:
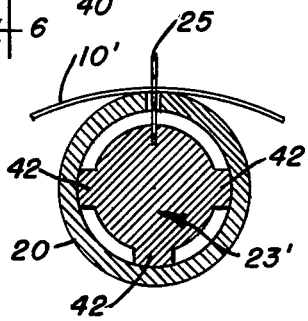
FIG. 6 is a cross-sectional view taken along the line 6—6 of FIG. 5.
Figure 7:
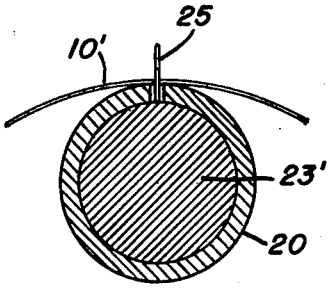
FIG. 7 is a cross-sectional view taken along the line 7—7 of FIG. 5.

A modification of the shuttle construction is shown in FIGS. 5–7. Here, the shuttle 23' has a central section 36 having a uniform diameter which is slightly less than the inside diameter of the supporting tube 20. The shuttle has intermediate sections 37 and 38 which are of a reduced diameter and terminate in end sections 39 and 40, the latter sections including integral, radially-extending portions 42 which are in sliding engagement with the inner wall of the tube 20, see particularly FIG. 6. In this arrangement, the reduced air pressure acting on the downstream end of the shuttle is effective in the region of the cutting blades, thereby assuring a taut condition of the strip 10' at the instant that it is being severed. FIG. 5 includes a portion of the structure 43 for securing the strip-severing mechanism in proper operating position on a winding machine.

Figure 8:
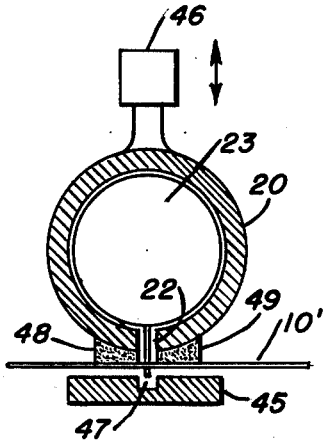
FIGS. 8 and 9 are fragmentary, cross-sectional views showing other modifications of the invention wherein the strip severing mechanism is positioned above the strip to be severed.
Figure 9:
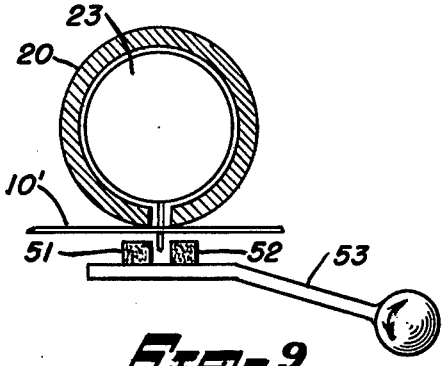

In the above-described strip-severing arrangements a vacuum condition is established within the supporting tube for the purpose of driving the shuttle to the opposite end of the tube and to draw the strip into the slot along which the cutter blades move. FIGS. 8 and 9 are fragmentary cross-sectional views showing shuttle driving arrangements which will work under conditions of air pressure, vacuum or a combination of both. In FIG. 8, the supporting tube 20, containing the shuttle 23, is mounted on the machine for movement toward and away from a fixed member 45 as, for example, by an air cylinder 46. The member 45 extends substantially the full length of the tube 20 and is provided with a groove 47 aligned with and normally spaced from the longitudinally extending slot 22 through which cutter blades extend. Pads 48 and 49 of resilient material are secured to the tube 20 along the slot 22. When the strip 10' is to be severed, the tube 20 is moved toward the member 45 and the strip 10' is clamped between the surface of the member 45 and the pads 48, 49. Air pressure then is applied to drive the shuttle from one to the other end of the tube 20. In FIG. 9, the resilient pads 51 and 52 are secured to a pivotally-mounted member 53, said member 53 being rotatable to cause the pads to press the strip 10' against the surface of the tube 20 during the strip-severing operation.

Figure 10:
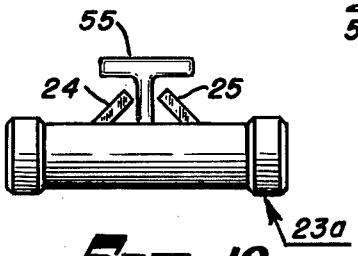
FIG. 10 is a side elevational view of a shuttle carrying a guard.
Figure 11:
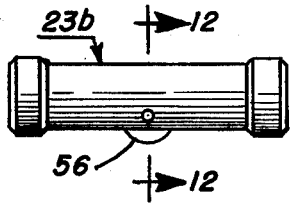
FIG. 11 is a side elevational view of the shuttle provided with a circular cutting member.
Figure 12:
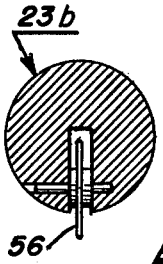
FIG. 12 is a cross-sectional view taken along the line 12—12 of FIG. 11 and drawn to an enlarged scale.
Figure 13:
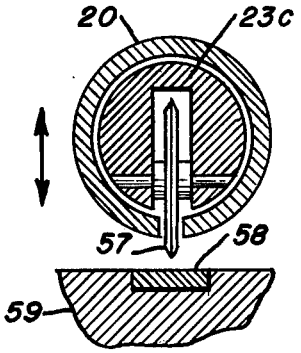
FIG. 13 is a fragmentary, cross-sectional view showing another embodiment of the invention.

FIG. 10 shows a shuttle **23*a* carrying a safety guard 55 which extends through the longitudinal slot of the shuttle-carrying tube and overlies the cutter blades 24 and 25. In FIGS. 11 and 12, the cutter member carried by the shuttle 23*b* is a circular blade 56. In the FIG. 13 arrangement, the shuttle 23*c* carries a score knife 57 and the shuttle-carrying tube 20 is mounted for movement toward and away from a hardened anvil 58 carried by a fixed support 59. During the winding operation, the strips pass freely between the anvil and the tube 20**. During the strip-severing cycle the tube is moved toward the anvil to clamp the strips therebetween, after which the score knife is driven through the tube.

While the various embodiments of the invention have been described with specific reference to a web-slitting machine, the various strip-severing mechanisms function equally well on uncut webs, turret winders the unwinders. In the arrangement illustrated in FIG. 2, the spacing between adjacent slit strips 10' preferable is very small so that the strips act as an air seal to minimize reduction of the vacuum in the shuttle-carrying tube 20 during the strip-severing operation. The use of vacuum to drive the shuttle 23 through the tube 20 is advantageous as the cutter blades make a clean, straight cut from one side of the strips, or web, without need of a mechanical back-up device on the opposite side of the strips.

Having now described the invention, what I desire to protect by letters patent is set forth in the following claims:

1. A cutting knife arrangement for use in severing relatively thin webs of material, said arrangement comprising:

a. a supporting tube having a longitudinally extending slot formed in the wall thereof, b. a shuttle slidably positioned within the tube and normally disposed at one end thereof, c. cutter means carried by the shuttle and extending through the said slot, said d. means for reducing the air pressure within the tube between the shuttle and the other end of the tube, thereby to move the shuttle to the other end of the tube.

2. The arrangement as recited in claim 1, wherein the said shuttle comprises a body portion of reduced diameter and terminating in end portions which are in sliding engagement with the inner wall of said tube.

3. The arrangement as recited in claim 2, wherein the end portions of the shuttle each have a plurality of axially-extending openings extending therethrough.

4. The arrangement as recited in claim 1, wherein the said cutter means comprises a generally rectangular blade.

5. The arrangement as recited in claim 1, wherein the said means for driving the shuttle comprises a source of reduced air pressure and means selectively operable to connect the said source to one or the other end of said tube.

6. The arrangement as recited in claim 1, wherein the said means for driving the shuttle comprises an air cylinder having a piston slidably disposed therein, a first air line connected between one end of said cylinder and one end of said tube, and a second air line connected between the other end of said cylinder and the other end of said tube.

7. The arrangement as recited in claim 1, including pads of resilient material secured to the outer wall of said tube and extending along the said slot, a back-up member having a groove aligned with and normally spaced from the said longitudinally-extending slot, and means mounting the said tube and back-up member for relative movement toward and away from each other in a plane normal to the tube axis.

8. The arrangement as recited in claim 1, including a back-up member carrying a pair of resilient pads, and means mounting the said back-up member and said tube for relative movement toward and away from each other in a plane substantially normal to the tube axis.

9. The arrangement as recited in claim 1, wherein said cutter means is a rotatable knife; and including an anvil aligned with the said longitudinally-extending slot, and means mounting the said anvil and said tube for relative movement toward and away from each other in a plane normal to the tube axis.

* * * * *